United States Patent [19]

Lorant

[11] 4,417,443

[45] Nov. 29, 1983

[54] MULTI-CYLINDER, DOUBLE-ACTING HOT GAS ENGINE

[75] Inventor: Stefan Lorant, Oxie, Sweden

[73] Assignee: Kommanditbolaget United Stirling (Sweden) A.B. & Co., Malmo, Sweden

[21] Appl. No.: 292,704

[22] Filed: Aug. 13, 1981

[51] Int. Cl.[3] ..... F02G 1/04

[52] U.S. Cl. ..... 60/525; 60/517

[58] Field of Search ..... 60/517, 525, 526

[56] References Cited

U.S. PATENT DOCUMENTS

| | | | |
|---|---|---|---|
| 3,478,511 | 11/1969 | Schwemin | 60/525 |
| 3,861,146 | 1/1975 | Lynch et al. | 60/526 X |
| 4,069,671 | 1/1978 | Berntell | 60/525 |

*Primary Examiner*—Allen M. Ostrager
*Assistant Examiner*—Stephen F. Husar
*Attorney, Agent, or Firm*—Finnegan, Henderson, Farabow, Garrett & Dunner

[57] ABSTRACT

A five cylinder, double-acting hot gas engine having pistons acting on a common crankshaft has been designed with the central cylinder forming a larger V-angle relative its two neighboring cylinders and a smaller V-angle with the two remote cylinders.

2 Claims, 2 Drawing Figures

MULTI-CYLINDER, DOUBLE-ACTING HOT GAS ENGINE

BACKGROUND OF THE INVENTION

1. Field of the Invention

The present invention relates to a multi-cylinder, double-acting hot gas engine of the kind in which each cylinder is surrounded by a ring-shaped regenerator housing.

2. Description of the Prior Art

Hot gas engines of the type referred to have been designed with the cylinders arranged in-line, in V-configuration or in two parallel lines, the latter claiming use of two parallel crankshafts. It is generally desirable to design the engine with a single combustion chamber as the control systems will be more simple. Also it is advantageous from a mechanical point of view to use a single crankshaft. An engine of this type has been described e.g. in the U.S. Pat. No. 4,261,173. Hitherto the maximum number of cylinders which could be included has been regarded to be four. Proposals have been made to provide six-cylinder engines—e.g. illustrated in U.S. Pat. No. 4,261,172, but such engines have been provided with two parallel crankshafts and separate regenerator housings.

SUMMARY OF THE INVENTION

The object of the present invention is to provide a low volume, low weight hot gas engine having a high power output suitable e.g. for automotive use. Therefore in accordance with the present invention a multi-cylinder, double-acting hot gas engine of the kind in which each cylinder is surrounded by a ring-shaped regenerator housing, the top of each cylinder being connected to the top of its surrounding regenerator housing by a number of heater tubes, said cylinders containing pistons connected to a single common crankshaft via piston and connecting rods is characterised in that five such cylinders are disposed symmetrically relative to a plane perpendicular to said single crankshaft, a first cylinder and its two neighbouring cylinders being disposed in V-configuration, the remaining two cylinders being arranged outside said two neighbouring cylinders with their axis disposed in a plane containing the axis of the crankshaft, said plane forming an angle with the axis of said first cylinder being less than 50% of the angle between said first cylinder and its neighbouring cylinders.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Figure 1:
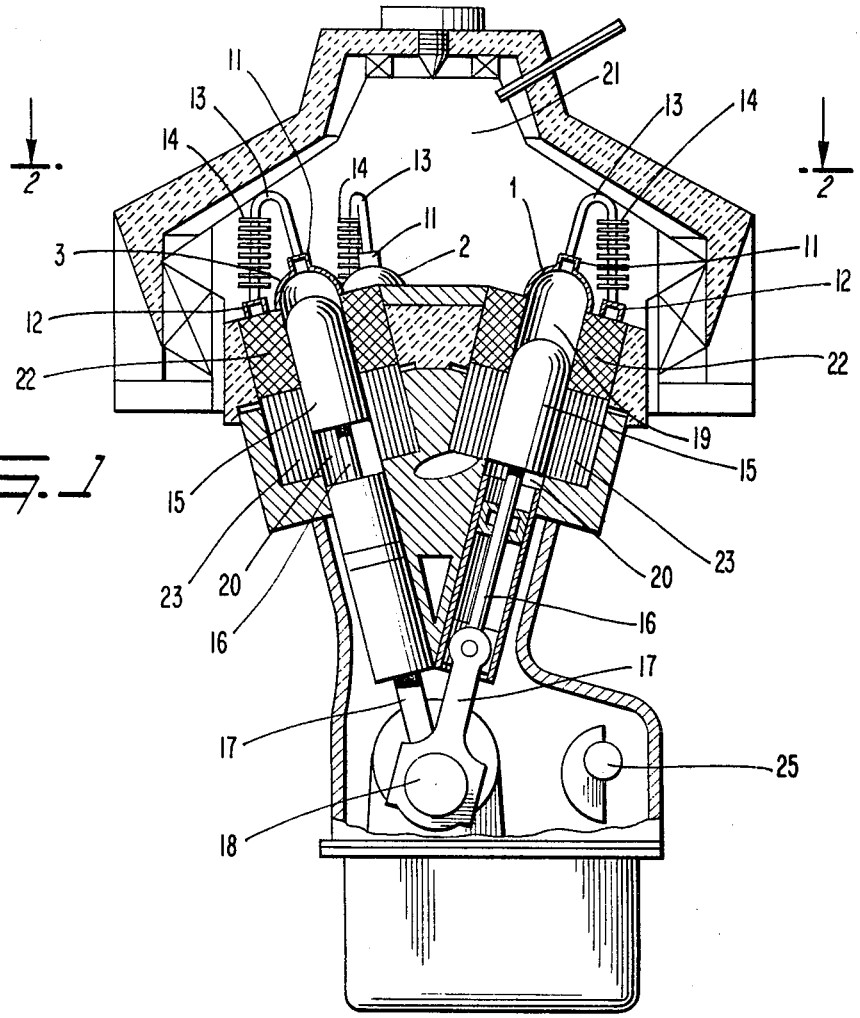
FIG. 1 is a vertical section through a hot gas engine according to the invention, the section being taken along the line I—I of FIG. 2.

Reference will now be made in detail to the preferred embodiment of the invention shown in the drawing.

Figure 2:
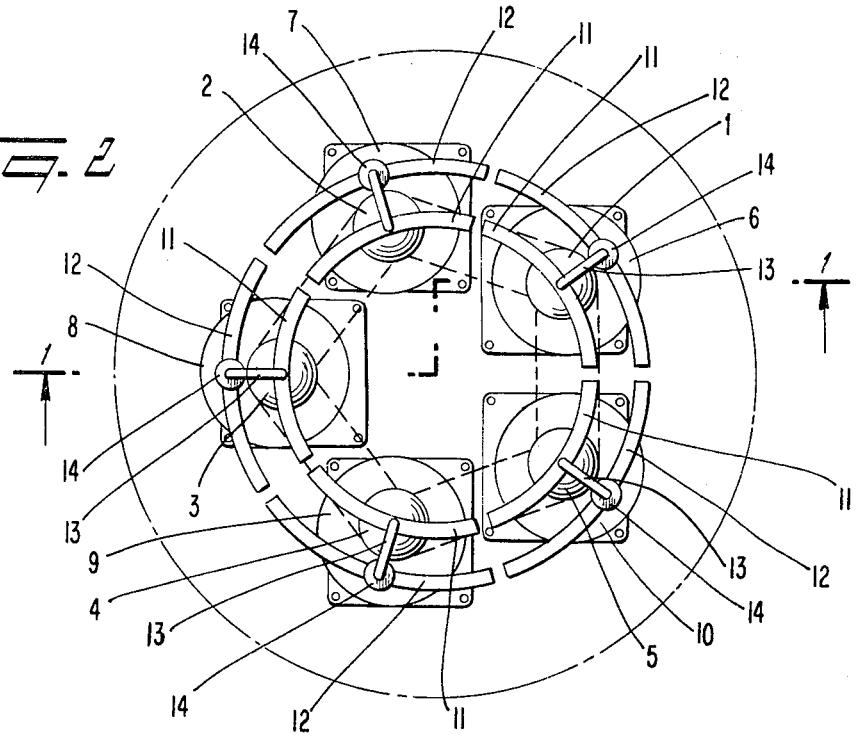
FIG. 2 is a view of a part of the engine shown in FIG. 1, the view being in the direction of the arrows II—II of FIG. 1.

FIG. 1 and FIG. 2 illustrate a five-cylinder, double-acting hot gas engine. The five cylinders are designated by the reference numbers 1–5 and each cylinder is surrounded by a regenerator housing, said housing being designated by 6–10. The tops of the cylinders are provided with individual arcuately shaped cylinder manifolds 11 which in their relative positions shown in FIG. 2 form a circle. The tops of the regenerator housings are provided with individual regenerator manifolds 12 which—as shown in FIG. 2—form a circle of greater diameter than that formed by the manifolds 11.

The pairs of manifolds 11 connected to the cylinders and manifolds 12 connected to the regenerator housings are interconnected by tubes 13 radially extending between said manifolds starting as shown in FIG. 1 from the manifolds 11 and extending outwardly and upwardly towards a top position from which they extend vertically downwardly to the regenerator housing manifolds 12 said tubes 13 being provided with surface enlarging fins 14.

Each cylinder 1–5 contains a piston 15 mounted for reciprocation therein, said piston being provided with a piston rod 16 secured to a connection rod 17 journalled to a crankshaft 18.

The pistons 15 separate each cylinder into a high temperature working chamber 19 and a low temperature working chamber 20. The heater tubes 13 traverse combustion chamber 21. The regenerator housings 6–10 each contain a regenerator 22 and a cooler 23 both surrounding the cylinders 1–5. Each gas space below a cooler 23 is connected to the low temperature working chamber 20, the connections being shown in dotted lines in FIG. 2. The engine also includes a preheater 24. A shaft 25 is connected to the crankshaft 18 and acts as a balancing shaft.

The engine has been designed substantially symmetrical relative to a vertical plan following the dash dotted straight line A—A in FIG. 2. The cylinder 3 with its surrounding regenerator housing 8 is centrally mounted. The axis of said cylinder forms a V with the axis of the cylinders 1 and 5, said angle being visible in FIG. 1. Said cylinders 1 and 5 are neighbouring cylinders relative the cylinder 3 in the direction of the crankshaft 18. The extreme cylinders 2 and 4 also forms a V with the cylinder 1, but the V angle is less than half the angle between the cylinders 3 and 1. It will be understood that the tops of the five cylinders 1–5 are almost evenly distributed along a circle if viewed from above (FIG. 2). Thus it is possible to design a five cylinder, double-acting hot gas engine having a single crankshaft.

The engine shown and described will function in basically the same way as the engine described e.g. in U.S. Pat. Nos. 4,261,172 and 4,261,173. Due to the numbers of cylinders the phase angle between the compression and expansion will be 108 degrees, instead of 90 degrees or 120 degrees as in the previous proposals for four cylinder and six cylinder engines.

I claim:

1. An improved multi-cylinder double-acting hot gas engine of the kind in which each cylinder is surrounded by a ring-shaped regenerator housing, the top of each said cylinder being connected to the top of its surrounding regenerator housing by a number of heater tubes, said cylinders containing pistons connected to a single common crankshaft via connecting rods, the improvement comprising five such cylinders disposed symmetrically relative a plane perpendicular to said single crankshaft, a first cylinder and its two neighbouring cylinders along the crankshaft axis being disposed in a V-configuration, and the remaining two cylinders being arranged outside said two neighbouring cylinders with their axes disposed in a plane containing the axis of the crank shaft, said plane forming an angle with the axis of said first cylinder being less than 50% of the angle between the axis of said first cylinder and a plane containing the axes of said two neighbouring cylinders.

2. A hot gas engine according to claim 1 in which each cylinder and regenerator housing at their tops are provided with manifolds being arcuately shaped and forming together two substantially complete concentrically disposed circles.

* * * * *